US009702276B2

(12) United States Patent
Baltrucki et al.

(10) Patent No.: US 9,702,276 B2
(45) Date of Patent: Jul. 11, 2017

(54) SYSTEM COMPRISING AN ACCUMULATOR UPSTREAM OF A LOST MOTION COMPONENT IN A VALVE BRIDGE

(71) Applicant: Jacobs Vehicle Systems, Inc., Bloomfield, CT (US)

(72) Inventors: Justin Baltrucki, Canton, CT (US); G. Michael Gron, Granby, CT (US); Biao Lu, W. Hartford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 56 days.

(21) Appl. No.: 14/799,837

(22) Filed: Jul. 15, 2015

(65) Prior Publication Data

US 2016/0017773 A1 Jan. 21, 2016

Related U.S. Application Data

(60) Provisional application No. 62/024,629, filed on Jul. 15, 2014.

(51) Int. Cl.
*F01L 9/02* (2006.01)
*F01L 1/14* (2006.01)
(Continued)

(52) U.S. Cl.
CPC ..... *F01L 1/146* (2013.01); *F01L 1/18* (2013.01); *F01L 1/46* (2013.01); *F01L 9/02* (2013.01);
(Continued)

(58) Field of Classification Search
CPC ... F01L 1/146; F01L 1/181; F01L 1/20; F01L 1/26; F01L 9/02
(Continued)

(56) References Cited

U.S. PATENT DOCUMENTS 6,234,143 B1 5/2001 Bartel et al.
6,450,144 B2 9/2002 Janak et al.
(Continued)

FOREIGN PATENT DOCUMENTS

WO 2005089274 A2 9/2005
WO 2010141633 A1 9/2010

OTHER PUBLICATIONS

International Search Report and Written Opinion received in PCT/US2015/040502; mailed Oct. 21, 2015; 11 pgs.

*Primary Examiner* — Ching Chang
(74) *Attorney, Agent, or Firm* — Moreno IP Law LLC

(57) ABSTRACT

Systems for actuating at least two engine valves comprise a valve bridge operatively connected to the at least two engine valves and having a hydraulically-actuated lost motion component. The lost motion component comprises a lost motion check valve disposed therein. A rocker arm has a motion receiving end configured to receive valve actuation motions from a valve actuation motion source and a motion imparting end for conveying the valve actuation motions and hydraulic fluid to the lost motion component. The rocker arm is in fluid communication with a hydraulic fluid supply. The systems also comprise an accumulator in fluid communication with the hydraulic fluid supply and disposed upstream of the lost motion check valve. In all embodiments, a fluid supply check valve may be disposed upstream of the accumulator and configured to prevent flow of hydraulic fluid from the accumulator back to the hydraulic fluid supply.

10 Claims, 6 Drawing Sheets

(51) Int. Cl.

| | |
|---|---|
| ***F01L 1/18*** | (2006.01) |
| ***F01L 1/46*** | (2006.01) |
| ***F01L 13/06*** | (2006.01) |
| *F01L 1/26* | (2006.01) |
| *F01L 1/20* | (2006.01) |

(52) U.S. Cl.
CPC ..... *F01L 13/06* (2013.01); *F01L 13/065* (2013.01); *F01L 1/181* (2013.01); *F01L 1/20* (2013.01); *F01L 1/26* (2013.01)

(58) Field of Classification Search
USPC ..... 123/90.12, 90.39, 90.13
See application file for complete search history.

(56) References Cited

U.S. PATENT DOCUMENTS

| | | | | |
|---|---|---|---|---|
| 6,883,492 | B2 * | 4/2005 | Vanderpoel | F01L 1/08 123/321 |
| 7,673,600 | B2 | 3/2010 | Yang | |
| 7,905,208 | B2 | 3/2011 | Ruggiero et al. | |
| 8,578,901 | B2 | 11/2013 | Ruggiero et al. | |
| 2007/0144472 | A1 | 6/2007 | Yang | |
| 2008/0087239 | A1 | 4/2008 | Wiley et al. | |
| 2008/0196680 | A1 | 8/2008 | Janak et al. | |
| 2010/0319657 | A1 | 12/2010 | Dodi et al. | |

* cited by examiner

- PRIOR ART -

- PRIOR ART -

SYSTEM COMPRISING AN ACCUMULATOR UPSTREAM OF A LOST MOTION COMPONENT IN A VALVE BRIDGE

CROSS-REFERENCE TO RELATED APPLICATION

The instant application claims the benefit of Provisional U.S. Patent Application Ser. No. 62/024,629 entitled "Valve Bridge With Integrated Lost Motion System" and filed Jul. 15, 2014, the teachings of which are incorporated herein by this reference.

The instant application is also related to co-pending U.S. patent application No. 14/799,813 entitled "Bias Mechanisms For A Rocker Arm And Lost Motion Component Of A Valve Bridge", and to co-pending U.S. patent application No. 14/800,092 entitled "Pushrod Assembly", both filed on even date herewith.

FIELD

The instant disclosure relates generally to actuating one or more engine valves in an internal combustion engine and, in particular, to valve actuation including a lost motion system.

BACKGROUND

As known in the art, valve actuation in an internal combustion engine controls the production of positive power. During positive power, intake valves may be opened to admit fuel and air into a cylinder for combustion. One or more exhaust valves may be opened to allow combustion gas to escape from the cylinder. Intake, exhaust, and/or auxiliary valves may also be controlled to provide auxiliary valve events, such as (but not limited to) compression-release (CR) engine braking, bleeder engine braking, exhaust gas recirculation (EGR), internal exhaust gas recirculation (IEGR), brake gas recirculation (BGR) as well as so-called variable valve timing (VVT) events such as early exhaust valve opening (EEVO), late intake valve opening (LIVO), etc.

As noted, engine valve actuation also may be used to produce engine braking and exhaust gas recirculation when the engine is not being used to produce positive power. During engine braking, one or more exhaust valves may be selectively opened to convert, at least temporarily, the engine into an air compressor. In doing so, the engine develops retarding horsepower to help slow a vehicle down. This can provide the operator with increased control over the vehicle and substantially reduce wear on the service brakes of the vehicle.

One method of adjusting valve timing and lift, particularly in the context of engine braking, has been to incorporate a lost motion component in a valve train linkage between the valve and a valve actuation motion source. In the context of internal combustion engines, lost motion is a term applied to a class of technical solutions for modifying the valve motion dictated by a valve actuation motion source with a variable length mechanical, hydraulic or other linkage assembly. In a lost motion system the valve actuation motion source may provide the maximum dwell (time) and greatest lift motion needed over a full range of engine operating conditions. A variable length system may then be included in the valve train linkage between the valve to be opened and the valve actuation motion source to subtract or "lose" part or all of the motion imparted from the valve actuation motion source to the valve. This variable length system, or lost motion system may, when expanded fully, transmit all of the available motion to the valve and when contracted fully transmit none or a minimum amount of the available motion to the valve.

An example of such a valve actuation system 100 comprising a lost motion component is shown schematically in FIG. 1. In particular, the system 100 illustrated in FIG. 1 is representative of a portion of the teachings found in U.S. Patent Application Publication No. 2010/0319657 ("the '657 Publication"), the teachings of which are incorporated herein by this reference. As shown, the valve actuation system 100 includes a valve actuation motion source 110 operatively connected to a rocker arm 120. The rocker arm 200 is operatively connected to a lost motion component 130 that, in turn, is operatively connected to one or more engine valves 140 that may comprise one or more exhaust valves, intake valves, or auxiliary valves. The valve actuation motion source 110 is configured to provide opening and closing motions that are applied to the rocker arm 120. The lost motion component 130 may be selectively controlled such that all or a portion of the motion from the valve actuation motion source 110 is transferred or not transferred through the rocker arm 120 to the engine valve(s) 140. The lost motion component 130 may also be adapted to modify the amount and timing of the motion transferred to the engine valve(s) 140 in accordance with operation of a controller 150. As known in the art, valve actuation motion source 110 may comprise any combination of valve train elements, including, but not limited to, one or more: cams, push tubes or pushrods, tappets or their equivalents. As known in the art, the valve actuation motion source 110 may be dedicated to providing exhaust motions, intake motions, auxiliary motions or a combination of exhaust or intake motions together with auxiliary motions.

The controller 150 may comprise any electronic (e.g., a microprocessor, microcontroller, digital signal processor, co-processor or the like or combinations thereof capable of executing stored instructions, or programmable logic arrays or the like, as embodied, for example, in an engine control unit (ECU)) or mechanical device for causing all or a portion of the motion from the valve actuation motion source 110 to be transferred, or not transferred, through the rocker arm 120 to the engine valve(s) 140. For example, the controller 150 may control a switched device (e.g., a solenoid supply valve) to selectively supply hydraulic fluid to the rocker arm 120. Alternatively, or additionally, the controller 150 may be coupled to one or more sensors (not shown) that provide data used by the controller 150 to determine how to control the switched device(s). Engine valve events may be optimized at a plurality of engine operating conditions (e.g., speeds, loads, temperatures, pressures, positional information, etc.) based upon information collected by the controller 150 via such sensors.

As further shown in FIG. 1, the rocker arm 120 is supplied with hydraulic fluid from a hydraulic fluid supply 160. Where the lost motion component 130 is hydraulically actuated, the hydraulic fluid provided by the hydraulic fluid supply 160 (as dictated, for example, by the controller 150) flows through the rocker arm 120. In the so-called bridge brake implementation taught in the '657 Publication, the lost motion component 130 resides in a valve bridge (not shown in FIG. 1) and comprises a check valve that permits the one-way flow of fluid into the lost motion component 130.

In such systems, the supply of the necessary hydraulic fluid is of critical importance to the successful operation of the valve actuation system 100. FIG. 2 illustrates an embodiment of known exhaust valve motions employed to perform compression release braking as function of valve lift (vertical axis) relative to crankshaft angle (horizontal axis), including a main exhaust valve event 202, a compression release valve event 204 and a BGR valve event 206. As shown in FIG. 2, the supply of the necessary hydraulic fluid in prior art systems (including the systems taught in the '657 Publication) occurs between the end of the main exhaust valve event 202 and the beginning of the BGR valve event 206, i.e., an event requiring actuation of the lost motion component 130. However, when operating at high engine speeds, the illustrated refill period can be very short. As a result, the pressure and flow of the hydraulic fluid may not be adequate to actuate the lost motion component 130, which in turn may result in loss of performance or high loading on the valve train.

To address this situation, the '657 Publication describes a system in which an accumulator 170 is provided in the valve bridge, which accumulator 170 is configured to harvest hydraulic fluid periodically discharged by the lost motion component 130. Consequently, the accumulator 170 is configured to reside downstream of the check valve residing in the lost motion component 130. During subsequent actuations of the lost motion component 130, i.e., during the refill period illustrated in FIG. 2, the accumulated hydraulic fluid is used to supplement the supply of hydraulic fluid otherwise provided by the rocker arm 120 to the lost motion component 130.

While the above-described system in the '657 Publication represents a welcome advancement of the art, still further solutions may prove advantageous.

SUMMARY

The instant disclosure describes systems for actuating at least two engine valves in a valve actuation system comprising a valve bridge operatively connected to the at least two engine valves and having a hydraulically-actuated lost motion component. The lost motion component comprises a lost motion check valve disposed therein. The systems further comprise a rocker arm having a motion receiving end configured to receive valve actuation motions from a valve actuation motion source and a motion imparting end for conveying the valve actuation motions and hydraulic fluid to the lost motion component. The rocker arm is in fluid communication with a hydraulic fluid supply. The systems also comprise an accumulator in fluid communication with the hydraulic fluid supply and disposed upstream of the lost motion check valve.

In an embodiment, the lost motion component may comprise a first piston disposed in a first piston bore also formed in the valve bridge. The first piston may comprise a cavity formed therein with the lost motion check valve disposed within the cavity, as well as an opening in fluid communication with the cavity and configured to receive hydraulic fluid from the rocker arm.

In another embodiment, the accumulator may also be disposed within the valve bridge. In this embodiment, the accumulator may comprise an accumulator bore formed in the valve bridge and an accumulator piston disposed therein and biased out of the accumulator bore. Further, the first piston may comprise a side opening in fluid communication with both the opening and the accumulator bore. Thus, a portion of the hydraulic fluid flowing through the opening and into the cavity, prior to flowing through the check valve, may also flow into the accumulator bore.

In another embodiment, the accumulator may be disposed within the rocker arm. In this embodiment, the rocker arm may comprise a hydraulic passage in fluid communication with the hydraulic fluid supply. The hydraulic passage may be formed in either the motion imparting end or the motion receiving end of the rocker arm. Regardless, the accumulator may comprise an accumulator bore formed in the rocker arm and in fluid communication with the hydraulic passage, and an accumulator piston disposed therein and biased out of the accumulator bore.

In yet another embodiment, the accumulator may be disposed in the hydraulic fluid supply. For example, the hydraulic fluid supply may comprise a rocker shaft having a fluid supply passage formed therein. In this case, the accumulator may comprise an accumulator bore formed in the rocker shaft and in fluid communication with the fluid supply passage, and an accumulator piston disposed therein and biased out of the accumulator bore.

In all embodiments, a fluid supply check valve may be disposed upstream of the accumulator and configured to prevent flow of hydraulic fluid from the accumulator back to the hydraulic fluid supply.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
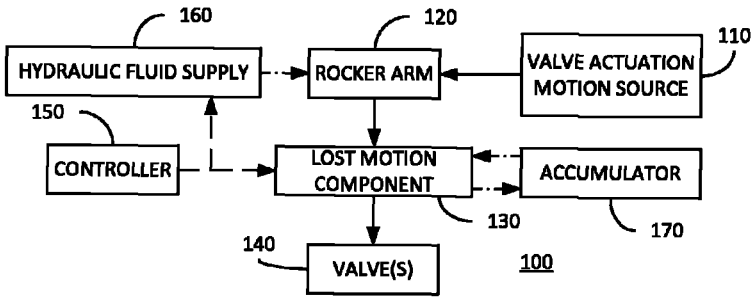
FIG. 1 is a block diagram schematically illustrating a valve actuation system in accordance with prior art techniques.
Figure 2:
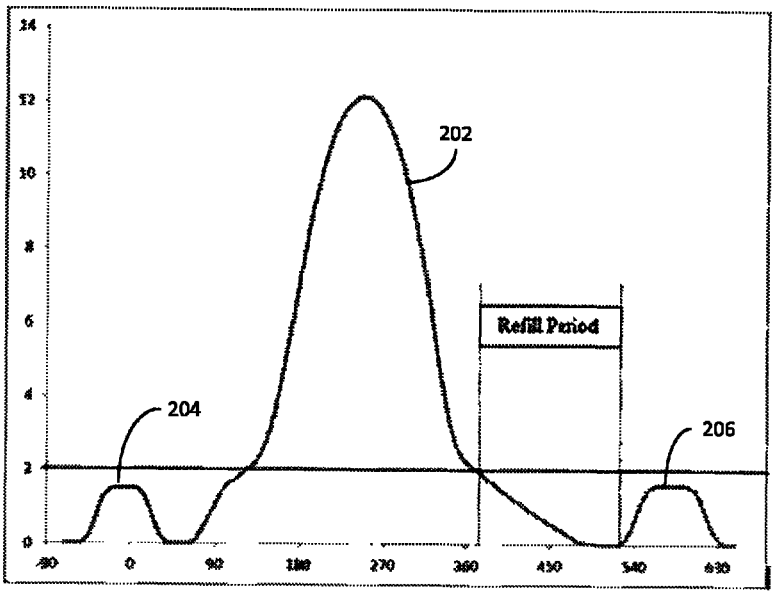
FIG. 2 is a chart illustrating valve lifts in accordance with prior art techniques.
Figure 3:
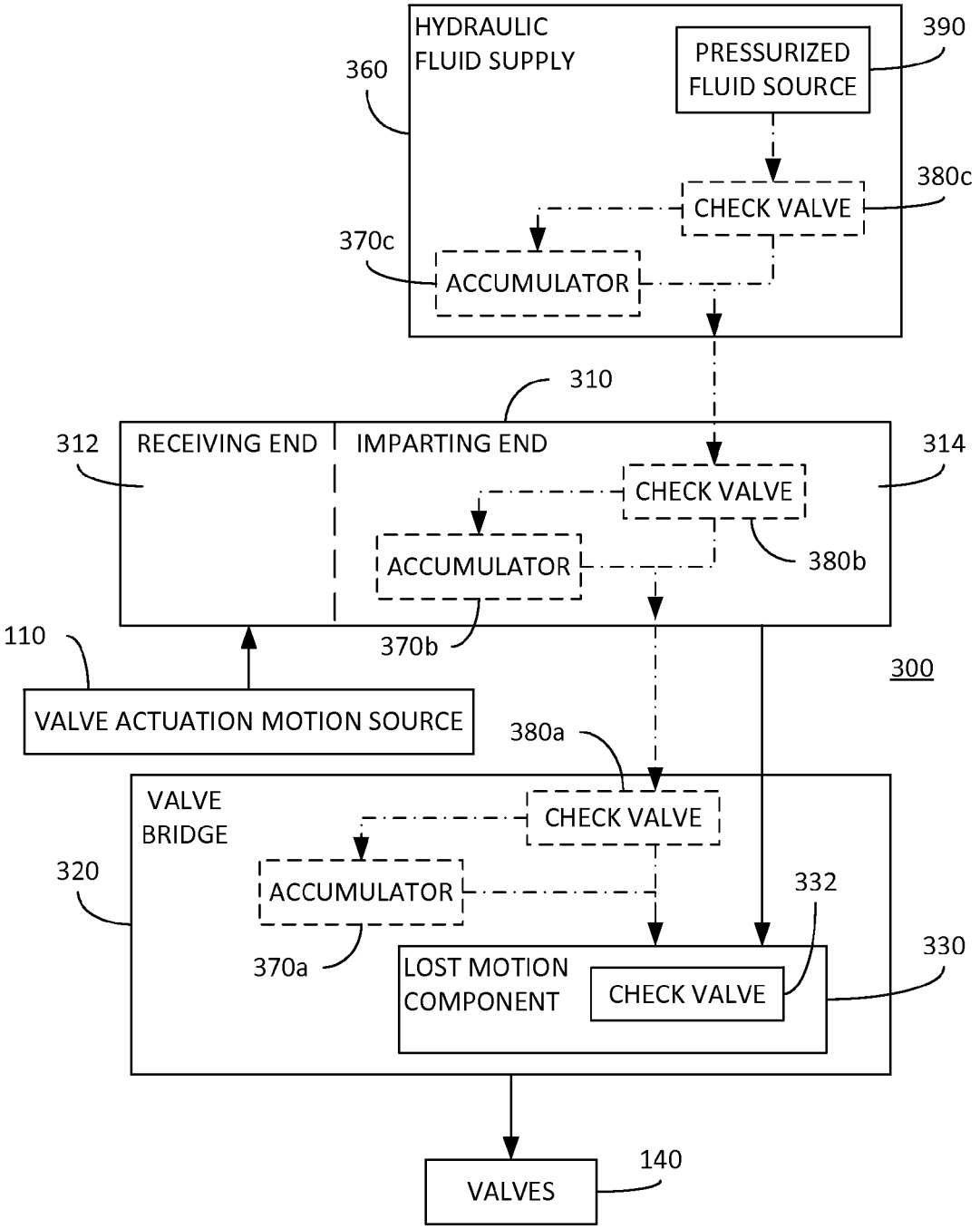
FIG. 3 is a block diagram schematically illustrating a valve actuation system in accordance with the instant disclosure.

Referring now to FIG. 3, a valve actuation system 300 in accordance with the instant disclosure is illustrated. As shown, the system 300 comprises a valve actuation motion source 110, as described above, operatively connected to a motion receiving end 312 of a rocker arm 310. The rocker arm 310 also comprises a motion imparting end 314. A hydraulic fluid supply 360 is in fluid communication with the rocker arm 310. The system 300 further comprises a valve bridge 320 operatively connected to the two or more engine valves 140. As known in the art of bridge brake systems, the valve bridge 320 may comprise a lost motion component 330.

Though not illustrated in FIG. 3, the rocker arm 310 is typically supported by a rocker arm shaft and the rocker arm 310 reciprocates about the rocker arm shaft. Also, as known in the art, the rocker arm shaft may incorporate elements of the hydraulic fluid supply 360 in the form of hydraulic fluid passages formed along the length of the rocker arm shaft. As further known in the art, the motion receiving end 312 may comprise any of a number of suitable configurations depending on the nature of the valve actuation motion source 110. For example, where the valve actuation motion source 110 comprises a cam, the motion receiving end 312 may comprise a cam roller. Alternatively, where the valve actuation motion source 110 comprises a push tube, the motion receiving end 312 may comprise a suitable receptacle surface configured to receive the end of the push tube. The instant disclosure is not limited in this regard.

As shown, the motion imparting end 314 of the rocker arm 310 conveys valve actuation motions (solid arrows) provided by the valve actuation motion source 110 to the lost motion component 330 of the valve bridge 320. Though not shown in FIG. 3, one or more hydraulic passages are provided in the motion imparting end 314 of the rocker arm 310 such that hydraulic fluid (dashed-dotted arrows) received from the hydraulic fluid supply 360 may also be conveyed to the lost motion component 330 via the motion imparting end 314. As further illustrated below, the motion imparting end 314 may comprise one or more components, in addition to the body of the rocker arm 310 itself, that facilitate the conveyance of the valve actuation motions and hydraulic fluid to the lost motion component 330.

The valve bridge 320 operatively connects to two or more engine valves 140 that, as noted previously, may comprise intake valves, exhaust valves and/or auxiliary valves, as known in the art. The lost motion component 330 is supported by the valve bridge 320 and is configured to receive the valve actuation motions and hydraulic fluid from the motion imparting end 314 of the rocker arm 310. The lost motion component 330 is hydraulically-actuated in the sense that the supply of hydraulic fluid causes the lost motion component 330 to either assume a state in which the received valve actuation motions are conveyed to the valve bridge 320 and, consequently, the valves 140, or a state in which the received valve actuation motions are not conveyed to the valve bridge 320 and are therefore "lost." An example of a lost motion component in a valve bridge is taught in U.S. Pat. No. 7,905,208, the teachings of which are incorporated herein by this reference, in which valve actuation motions from the rocker arm are lost when hydraulic fluid is not provided to the lost motion component, but are conveyed to the valve bridge and valves when hydraulic fluid is provided to the lost motion component. In lost motion components 330 of this type, a check valve 332 is provided to permit one-way flow of hydraulic fluid into the lost motion component 330. The check valve 332 permits the lost motion component 330 to establish a locked volume of hydraulic fluid that, due to the substantially incompressible nature of the hydraulic fluid, allows the lost motion component 330 to operate in substantially rigid fashion thereby conveying the received valve actuation motions.

The hydraulic fluid supply 360 may comprise any components used to source and/or convey hydraulic fluid (e.g., engine oil) to the lost motion component 330 as illustrated in FIG. 3. Thus, as noted above, the hydraulic fluid supply 390 may comprise a rocker shaft having fluid supply passages formed therein. Alternatively, or additionally, the hydraulic fluid supply 390 may comprise a rocker shaft pedestal, as known in the art, likewise comprising fluid supply passages formed therein. Further still, the hydraulic fluid supply 360 may comprise a pressurized hydraulic fluid source 390 such as an engine oil pump.

An aspect of the lost motion component 330 as described above is that application of hydraulic fluid to the lost motion component is required in order to switch the lost motion component into a motion-conveying state. However, as noted above, during relatively high-speed operation, the time available to convey the necessary amount of hydraulic fluid to the lost motion component 330 to ensure proper operation may not be sufficient.

In order to ensure adequate supply of hydraulic fluid, one or more accumulators 370 may be deployed upstream of the lost motion check valve 332. As used herein, "upstream" refers to locations along the path used to supply hydraulic fluid to the lost motion component 330 that are closer to the hydraulic fluid supply 360 along the path than a reference location. Thus, the upstream accumulator(s) 370 described herein are located closer to the hydraulic fluid supply 360 as compared to the lost motion check valve 332. As known in the art, the accumulator(s) 370 (sometimes referred to as pressure regulators) operate to store hydraulic fluid at a pressure comparable to those pressures provided by the pressurized hydraulic fluid source 390. In the context of the instant disclosure, then, the accumulator(s) 370 operate to discharge their stored hydraulic fluid whenever pressure of the hydraulic fluid in the path leading up to the lost motion check valve 332 drops below the pressure of the accumulated hydraulic fluid, thereby increasing the average available hydraulic fluid pressure.

As shown in FIG. 3, the accumulator(s) 370 may be disposed at a number of locations upstream of the lost motion check valve 332. For example, an accumulator 370*a* may be disposed in the valve bridge 320. Alternatively, the accumulator 370*b* may be disposed in the rocker arm 310 or, in yet another alternative, the accumulator 370*c* may be disposed within the hydraulic fluid supply 360. Preferably, the accumulator 370 is disposed at an upstream location within the system 300 as close as possible to the lost motion check valve 332, which determination is likely to be a function of available space within the system 300.

As further shown in FIG. 3, one or more fluid supply check valves 380 may be deployed upstream of the accumulator(s) 370 to prevent flow of hydraulic fluid from the accumulator(s) 370 back to the hydraulic fluid supply 360. Thus, in one embodiment, each potential accumulator 370*a*, 370*b*. 370*c* has associated therewith, within the particular component 320, 310, 360 in which it is deployed, a corresponding fluid supply check valve 380*a*, 380*b*, 380*c*. As shown, each fluid supply check valve 380 is configured to permit flow of hydraulic fluid to any downstream components and to its corresponding accumulator 370. However, fluid discharged by the accumulator 370 is not permitted to flow upstream past its corresponding check valve 380. In another embodiment, the fluid supply check valve 380 is not necessarily deployed within the same component(s) as the accumulator(s) 370 that it checks. Thus, for example, the accumulator 370*a* deployed in the valve bridge 320 may be checked by the fluid supply check valve 380*b* deployed within the rocker arm 310, or the fluid supply check valve 380*c* deployed in the hydraulic, fluid supply 360.

Figure 4:
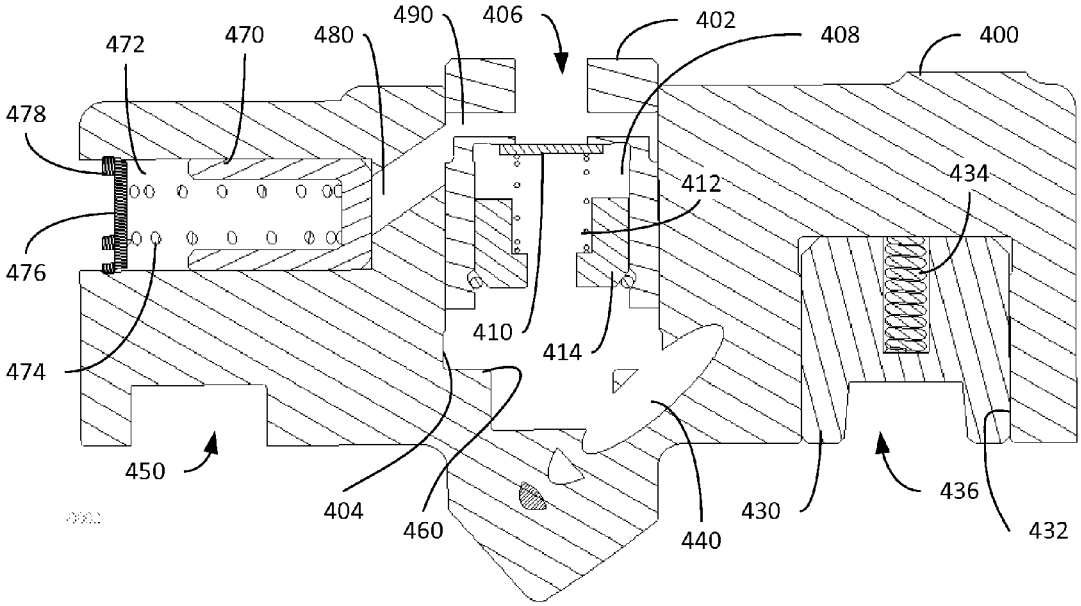
FIGS. 4 and 5 are cross-sectional views of a valve bridge in accordance with a first embodiment of the instant disclosure.

Specific embodiments in accordance with the instant disclosure are further illustrated in FIGS. 4-8. Referring now to FIG. 4, a valve bridge 400 is illustrated having a first piston 402 slidably disposed in a first piston bore 404 formed in the valve bridge 400. The first piston 402 and first piston bore 404 are configured, as described above, to receiving valve actuation motions and hydraulic fluid from the motion imparting end 314 of the rocker arm 310 (not shown). The first piston 402 may comprise an opening 406 providing fluid communication with a cavity 408 formed within the first piston 402. A check valve assembly comprising a check valve 410, check valve spring 412 and check valve retainer 414 are provided within the cavity 408. As known in the art, the check valve assembly permits one-way fluid communication from the motion imparting end 314 of the rocker arm 310 to the cavity 408 and first piston bore 404.

As further shown in FIG. 4, a second piston 430 may be slidably disposed within a second piston bore 432 formed in the valve bridge 400. The second piston 430 and second piston bore 432 are configured to align with an engine valve such that an end of the engine valve may be received in a corresponding receptacle 436 formed in the second piston 430. A second piston spring 434 is provided to bias the second piston 430 in a direction toward its corresponding engine valve. Further still, a hydraulic passage 440 (partially shown) is provided between the first piston bore 404 and the second piston bore 432. As known in the art, when the cavity 408, first piston bore 404, hydraulic passage 440 and first piston bore 432 are charged with hydraulic fluid, the first piston 402 and the second piston 430 act as master and slave pistons, respectively, such that valve actuation motions received by the first piston 402 are conveyed to the second piston 430 and it corresponding engine valve. As further shown, a receptacle 450 is provided on an end of the valve bridge opposite the second piston 430 such that the receptacle aligns with (and is configured to receive an end of) another engine valve (not shown). When the cavity 408, first piston bore 404, hydraulic passage 440 and first piston bore 432 are not charged with hydraulic fluid, travel of the first piston 402 is limited by shoulder 460 formed in the first piston bore 404. It is noted that yet another second piston and hydraulic passage arrangement could be provided in the place of the receptacle 450 such that the first piston 402 is capable of serving as a master piston to two slave pistons, rather than only one as illustrated in FIG. 4.

As further shown in FIG. 4, an accumulator may be provided as an accumulator piston 470 slidably disposed in an accumulator bore 472 formed in the valve bridge 400. The accumulator bore 472 is in fluid communication with a hydraulic passage 480 formed in the valve bridge 400, which hydraulic passage 480 is likewise in fluid communication with the opening 406 in the first piston 402 via a side opening 490 formed in the first piston 402. The hydraulic passage 480 is preferably configured so that it remains registered with (i.e., in fluid communication with) the side opening 490 despite any movement of the first piston 402 within the first piston bore 404. As further shown, the accumulator piston 470 is biased toward the hydraulic passage 480 by an accumulator spring 474 that, in this example, is maintained within the accumulator bore 472 by an accumulator retainer 476 and snap ring 478. Those having skill in the art will appreciate that resilient elements other than those illustrated in the instant Figures, e.g., flexible diaphragms, leaf springs, etc., could be used to bias the accumulator piston 470, which resilient elements could be deployed, e.g., inside or outside the bore, as a matter of design choice.

Figure 5:
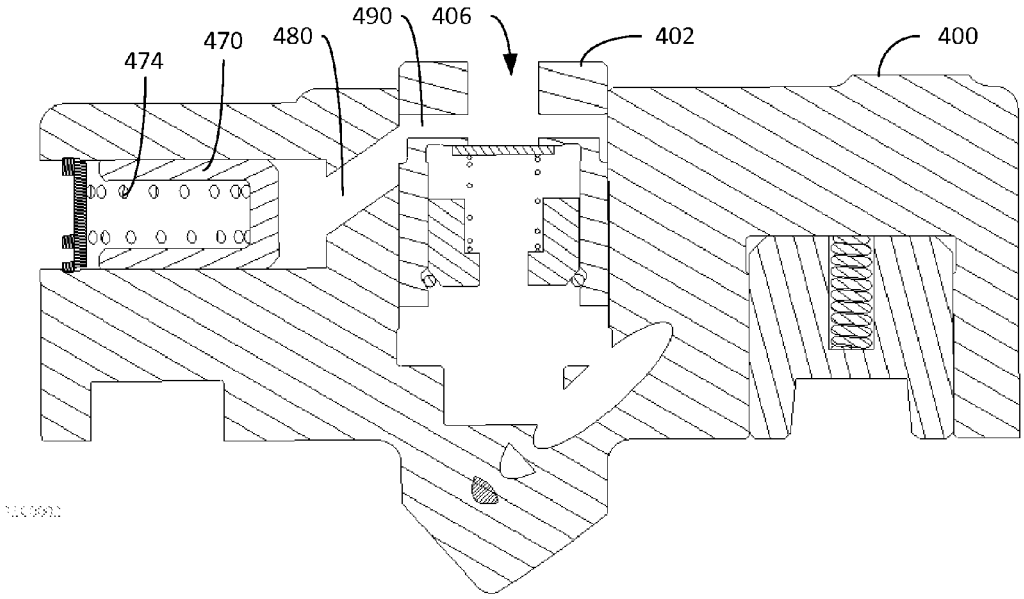

The accumulator spring 474 is preferably chosen such that the bias force it provides to the accumulator piston 470 is less than the fluid pressure exhibited within the hydraulic passage 480 during filling of the cavity 408 and first piston bore 404 thereby permitting the accumulator bore 472 to also fill with hydraulic fluid. This is illustrated in FIG. 5, where the accumulator piston 470 is displaced within the accumulator bore 472 (to the left in these illustrations) in response to fluid pressure present in the hydraulic passage 480. However, the bias force applied by the accumulator spring 474 is also sufficiently high to maintain the average fluid pressure at a desired level when the hydraulic fluid within the accumulator bore 472 is discharged as needed, thus allowing the accumulator piston 470 to displace once again toward the hydraulic passage 480 as illustrated in FIG. 4. By placing the accumulator upstream of the check valve assembly, refill of the cavity 408 and first piston bore 404 may be more readily achieved without relying on more complex fluid harvesting arrangements.

Figure 6:
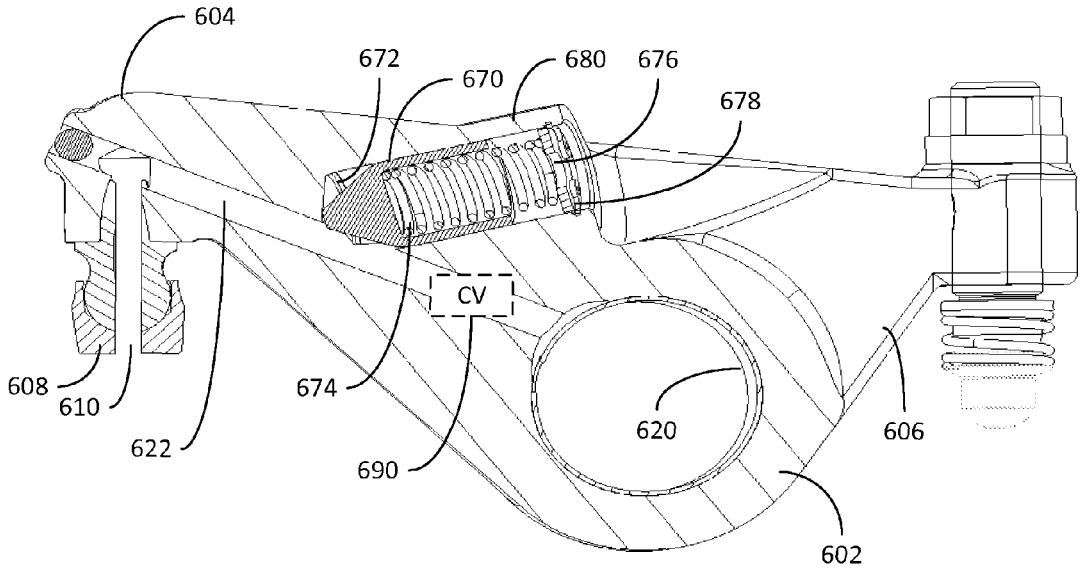
FIGS. 6 and 7 are cross-sectional views of a rocker arm in accordance with a second embodiment of the instant disclosure.

Referring now to FIG. 6, an embodiment in which an accumulator is disposed in a rocker arm 602 is further illustrated. In particular, the rocker arm 602 comprises a motion imparting end 604 and a motion receiving end 606, as described above, and a rocker shaft bore 620 configured to receive a rocker shaft (not shown). A hydraulic passage 622 is formed in the motion imparting end 604 of the rocker arm 602, an end of which is configured to fluidly communicate with a hydraulic fluid supply, such as rocker shaft hydraulic passages as known in the art. Such fluid supply for the valve bridge is typically switched (via a solenoid supply valve, for example) that permits pressure within the hydraulic passage 622 to be increased or decreased in order to control operation of the lost motion component. The motion imparting end 604 comprises a contact assembly 608 comprising a so-called elephant or swivel foot having a fluid passage 610 formed therein, which fluid passage 610 is in fluid communication with the hydraulic passage 622. In this manner, the rocker arm 602 is able to supply hydraulic fluid through the fluid passage 610 to the valve bridge and lost motion component (not shown).

In the embodiment illustrated in FIG. 6, an accumulator may be provided as an accumulator piston 670 slidably disposed in an accumulator bore 672 formed in an accumulator boss 680 of the rocker arm 602. The accumulator bore 672 is in fluid communication with the hydraulic passage 622. As known in the art, the hydraulic passage 622 is preferably configured so that it remains registered with (i.e., in fluid communication with) the fluid supply source in the rocker shaft (not shown) despite any movement of the rocker arm 602. As further shown, the accumulator piston 670 is biased toward the hydraulic passage 622 by an accumulator spring 674 that, in this example, is maintained within the accumulator bore 672 by an accumulator retainer 676 and snap ring 678. Once again, any of a variety of known resilient elements could be employed to bias the accumulator piston 670 as needed. Likewise, the bias force applied by the accumulator spring 674 is preferably low enough to permit filling of the accumulator bore 672 with hydraulic fluid, yet high enough to maintain sufficiently high fluid pressure when the accumulator discharges the stored hydraulic fluid. Filling of the accumulator bore 672 is illustrated in FIG. 7 where, as above relative to FIG. 5, application hydraulic fluid to the hydraulic passage 622 causes the accumulator piston 670 to displace within the accumulator bore 672 (to the right in these illustrations).

Figure 7:
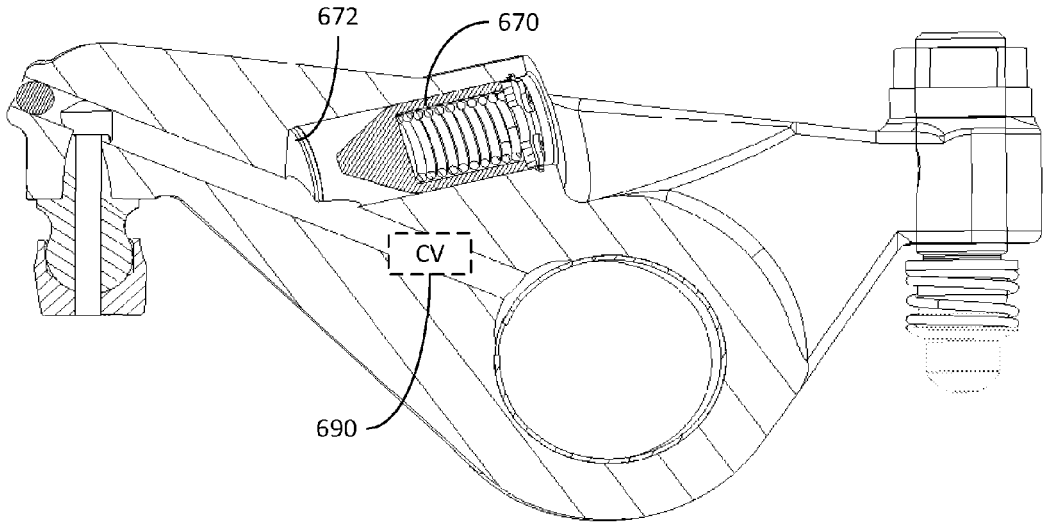

As shown in FIGS. 6 and 7, and as described above relative to FIG. 3, the rocker arm 602 may optionally comprise a fluid supply check valve 690 upstream of the accumulator piston 670 and accumulator bore 672. Thus, in the illustrated embodiment, the fluid supply check valve 690 is deployed within the hydraulic passage 662 between the accumulator bore 672 and the rocker shaft bore 620.

Figure 8:
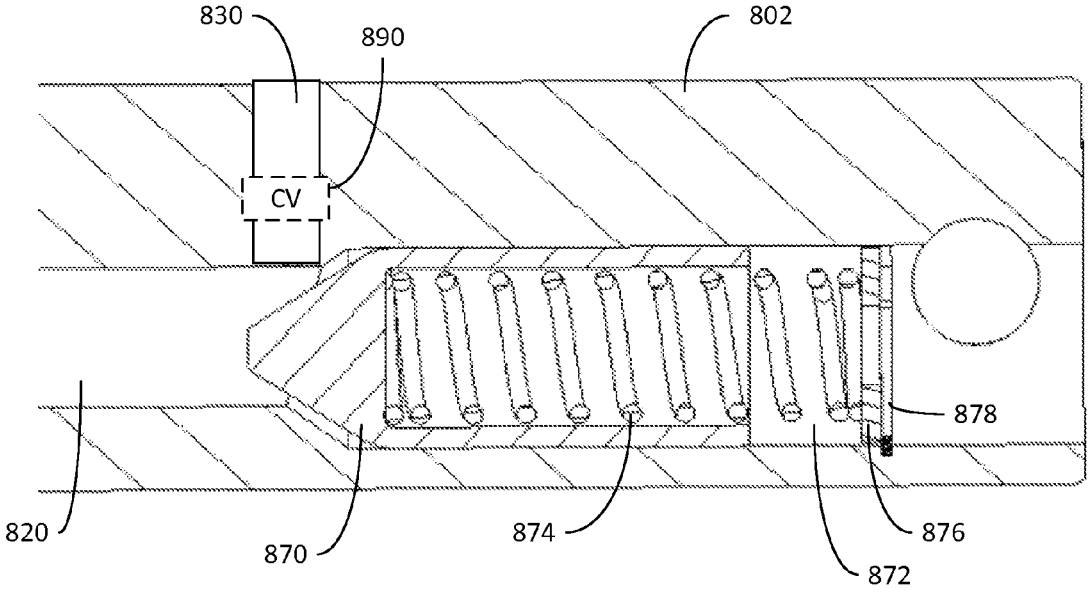
FIG. 8 is a cross-sectional view of a rocker shaft in accordance with a third embodiment of the instant disclosure.

Referring now to FIG. 8, an embodiment in which an accumulator is disposed within a rocker shaft 802 is illustrated. In this implementation, an accumulator piston 870 slidably disposed in an accumulator bore 872 formed, in this case, in an end of the rocker shaft 802. However, those having skill in the art will appreciate that the accumulator need not be deployed in the end of the rocker shaft 802 in all instances, and it may be desirable to deploy the accumulator at other points along the rocker shaft 802. Further, components typically used to support the rocker shaft 802 (e.g., a rocker shaft pedestal) and fluid connections to the rocker shaft 802 are not illustrated in FIG. 8. The accumulator bore 872 is in fluid communication with a fluid supply passage 820 that, as known in the art, is used to supply hydraulic fluid to the various components (i.e., rocker arms) in fluid communication with the rocker shaft 802. The fluid supply passage 820 is, in turn, in fluid communication with a side opening 830 that is coupled to a pressurized source of hydraulic fluid. Once again, in this embodiment, the accumulator piston 870 is biased toward the fluid passage 820 by an accumulator spring 874 that, in this example, is maintained within the accumulator bore 672 by an accumulator retainer 876 and snap ring 878. The qualifications of the accumulator spring 874 noted above relative to the embodiments of FIGS. 4-7 may apply equally to the implementation of FIG. 8. Likewise, as before, the rocker shaft 802 may comprise a fluid supply check valve 890 upstream of the accumulator piston 870 and accumulator bore 872. Thus, in the illustrated embodiment, the fluid supply check valve 890 is deployed within the side opening 830 between the accumulator bore 672 and the pressurized source of hydraulic fluid.

Figure 9:
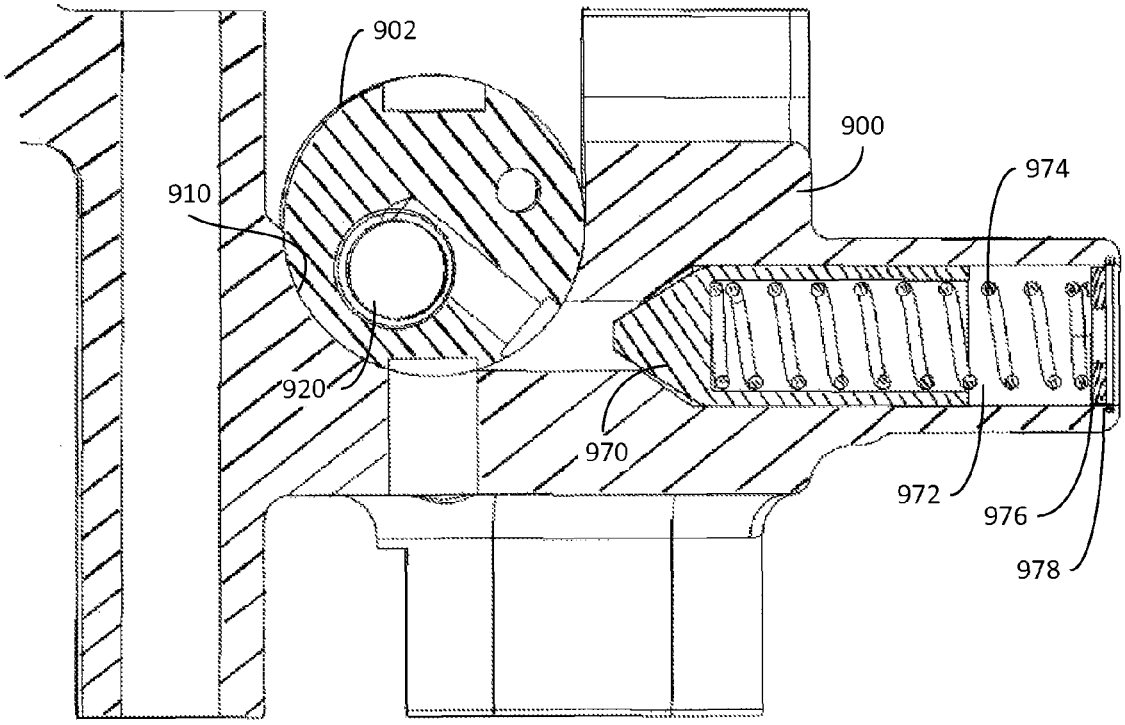
FIG. 9 is a cross-sectional view of a rocker pedestal in accordance with a fourth embodiment of the instant disclosure.

Finally, referring to FIG. 9, an embodiment in which an accumulator is disposed within a rocker shaft pedestal 900 is illustrated. In this implementation, an accumulator piston 970 slidably disposed in an accumulator bore 972 formed in the rocker shaft pedestal 900. As illustrated, the accumulator bore 972 is formed proximally to a rocker shaft receiving surface 910 configured to receive a rocker shaft 902. However, those having skill in the art will appreciate that the accumulator need not be deployed in this manner in all instances, and it may be desirable to deploy the accumulator at other, more distal locations within the rocker shaft pedestal 900. The accumulator bore 872 is in fluid communication with a fluid supply passage 920 that, as known in the art, is used to supply hydraulic fluid to the various components (i.e., rocker arms) in fluid communication with the rocker shaft 902. The fluid supply passage 920 is, in turn, in fluid communication with a pressurized source of hydraulic fluid (not shown). Once again, in this embodiment, the accumulator piston 970 is biased toward the fluid passage 920 by an accumulator spring 974 that, in this example, is maintained within the accumulator bore 972 by an accumulator retainer 976 and snap ring 978. The qualifications of the accumulator spring 974 noted above relative to the embodiments of FIGS. 4-8 may apply equally to the implementation of FIG. 9. Although not illustrated in FIG. 9, a fluid supply check valve may be provided upstream of the accumulator piston 970 and accumulator bore 972. For example, a fluid supply check valve may be provided is a side opening 830, as illustrated in FIG. 8, that is used to supply pressurized hydraulic fluid to the fluid supply passage 920.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. A system for actuating at least one of two or more engine valves in an internal combustion engine, the system comprising:

a hydraulic fluid supply;

a valve bridge operatively connected to the two or more engine valves, the valve bridge comprising a hydraulically-actuated lost motion component, the hydraulically-actuated lost motion component further comprising a lost motion check valve;

a rocker arm in fluid communication with the hydraulic fluid supply and having a motion receiving end configured to receive valve actuation motions from a valve actuation motion source and a motion imparting end configured to convey the valve actuation motions and hydraulic, fluid from the hydraulic fluid supply to the hydraulically-actuated lost motion component; and an accumulator in fluid communication with the hydraulic fluid supply and disposed upstream of the lost motion check valve.

2. The system of claim 1, further comprising:

a fluid supply check valve upstream of the accumulator configured to prevent flow of hydraulic fluid from the accumulator to the hydraulic fluid supply.

3. The system of claim 1, the lost motion component further comprising:

a first piston disposed in a first piston bore formed in the valve bridge, the first piston further comprising a cavity and the lost motion check valve disposed in the cavity, the first piston further comprising an opening in fluid communication with the cavity, wherein hydraulic fluid received from the rocker arm flows through the opening and the lost motion check valve into the cavity.

4. The system of claim 3, wherein the accumulator further comprises an accumulator bore formed in the valve bridge and an accumulator piston disposed in the accumulator bore, wherein the first piston further comprises a side opening in fluid communication with the opening in the first piston, wherein the valve bridge comprises a hydraulic passage in fluid communication with the first piston bore and the accumulator bore and configured to register with the side opening of the first piston, and wherein the accumulator piston is biased toward the hydraulic passage.

5. The system of claim 1, further comprising:

a hydraulic passage formed in the rocker arm and in fluid communication with the hydraulic fluid supply, wherein the accumulator further comprises an accumulator bore formed in the rocker arm and in fluid communication with the hydraulic passage and an accumulator piston disposed in the accumulator bore and biased toward the hydraulic passage.

6. The system of claim 5, wherein the hydraulic passage is formed in the motion imparting end of the rocker arm and configured to provide fluid communication between the hydraulic fluid supply and the lost motion component.

7. The system of claim 5, wherein the hydraulic passage is formed in the motion receiving end of the rocker arm.

8. The system of claim 1, wherein the accumulator is disposed in the hydraulic fluid supply.

9. The system of claim 8, further comprising:

a rocker shaft configured to support the rocker arm and comprising a fluid supply passage, wherein the accumulator further comprises an accumulator bore formed in the rocker shaft and in fluid communication with the fluid supply passage and an accumulator piston disposed within accumulator bore and biased toward the fluid supply passage.

10. They system of claim 8, further comprising:

a rocker pedestal configured to support a rocker shaft and comprising a fluid supply passage, wherein the accumulator further comprises an accumulator bore formed in the rocker pedestal and in fluid communication with the fluid supply passage and an accumulator piston disposed within accumulator bore and biased toward the fluid supply passage.

* * * * *